US009347157B2

(12) United States Patent
Zhang

(10) Patent No.: US 9,347,157 B2
(45) Date of Patent: May 24, 2016

(54) WARP KNITTED FABRIC COMPRISING POLYTRIMETHYLENE TEREPHTHALATE AND METHOD OF MAKING SAME

(71) Applicant: E I DU PONT DE NEMOURS AND COMPANY, Wilmington, DE (US)

(72) Inventor: Lizhi Zhang, Shanghai (CN)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 52 days.

(21) Appl. No.: 14/372,461

(22) PCT Filed: Jan. 15, 2013

(86) PCT No.: PCT/US2013/021514
§ 371 (c)(1),
(2) Date: Jul. 16, 2014

(87) PCT Pub. No.: WO2013/109513
PCT Pub. Date: Jul. 25, 2013

(65) Prior Publication Data

US 2015/0020546 A1 Jan. 22, 2015

(30) Foreign Application Priority Data

Jan. 16, 2012 (CN) ..... 2012 1 0012455

(51) Int. Cl.
*D04B 21/18* (2006.01)

(52) U.S. Cl.
CPC ..... *D04B 21/18* (2013.01); *D10B 2501/02* (2013.01)

(58) Field of Classification Search
CPC ..... D04B 21/18; D04B 21/08
USPC ..... 66/192, 202, 195; 442/306, 308
See application file for complete search history.

(56) References Cited

U.S. PATENT DOCUMENTS

| | | | | |
|---|---|---|---|---|
| 4,487,040 | A | 12/1984 | Patel et al. | |
| 4,802,346 | A | 2/1989 | Gajjar | |
| 6,458,455 | B1 * | 10/2002 | Hernandez | D01D 5/253 428/359 |
| 7,240,522 | B2 * | 7/2007 | Kondou | D04B 1/18 66/195 |
| 7,465,683 | B2 | 12/2008 | McMurray | |
| 7,842,628 | B2 * | 11/2010 | Yasui | A47B 17/00 442/181 |
| 7,921,677 | B2 * | 4/2011 | Susa | D04B 21/04 66/170 |
| 2002/0184925 | A1 | 12/2002 | McClellan et al. | |
| 2003/0094019 | A1 * | 5/2003 | Miyake | D04B 21/16 66/195 |
| 2003/0106346 | A1 * | 6/2003 | Matsumoto | D04B 21/10 66/195 |
| 2010/0055381 | A1 * | 3/2010 | Yamaguchi | A47C 31/006 428/91 |
| 2010/0125926 | A1 | 5/2010 | Simonetti et al. | |
| 2010/0229606 | A1 * | 9/2010 | Ikenaga | B60N 2/58 66/196 |

(Continued)

FOREIGN PATENT DOCUMENTS

| | | | |
|---|---|---|---|
| EP | 1152079 | A1 | 11/2001 |
| EP | 1403411 | A1 | 3/2004 |

(Continued)

OTHER PUBLICATIONS

International Search Report dated Jun. 4, 2013, International Application No. PCT/US2013/021514.

*Primary Examiner* — Danny Worrell

(57) ABSTRACT

This invention relates to warp knit fabric having a locknit pattern comprising polytrimethylene terephthalate yarn and elastic yarn having a weight ratio of from 70:30 to 90:10. The fabrics have a soft hand feel, better colorfastness after chlorine exposure and UV radiation as compared to other performance wear fabrics containing elastic yarn polyethylene terephthalate yarn.

7 Claims, 6 Drawing Sheets

(56) References Cited

U.S. PATENT DOCUMENTS

| | | | | |
|---|---|---|---|---|
| 2011/0099677 | A1 | 5/2011 | Mamiye et al. | |
| 2015/0020546 | A1* | 1/2015 | Zhang | D04B 21/18 66/202 |

FOREIGN PATENT DOCUMENTS

| | | | |
|---|---|---|---|
| KR | 20020001924 | A | 1/2002 |
| WO | 03023105 | A1 | 3/2003 |

* cited by examiner

WARP KNITTED FABRIC COMPRISING POLYTRIMETHYLENE TEREPHTHALATE AND METHOD OF MAKING SAME

FIELD OF THE INVENTION

This invention relates to warp knit fabrics comprising polytrimethylene terephthalate yarns and elastic yarns.

BACKGROUND OF THE INVENTION

To be used in performance wear such as swimwear, athletic apparel, or intimate apparel, the stretchable fabrics are required to have comfortable stretch and compression, good hand feel, as well as having high durability. Many of the stretchable fabrics contain elastic yarns, predominately spandex yarns which are warp-knitted with other hard yarns such as nylon or polyethylene terephthalate to provide the desired hand feel and durability.

Warp knit fabrics are well known materials. They can be conventionally produced on Ketten, Raschel or tricot knitting machines. Processes and apparatus for preparing warp knit fabrics are disclosed, for example, in U.S. Pat. Nos. 4,487,040 and 4,802,346 and in PCT Patent Application No. WO 03/023105. All of these patent documents are incorporated herein by reference.

Korean Patent Application No. 2002-0001924 discloses a method of manufacturing a warp knit fabric containing 70-95 weight % of 50-70 d polytrimethylene terephthalate (PTT) multifilament fibers and 5-30 weight % of 20-70 d spandex fibers on a 2 guide bar tricot machine of 28 gauge. The resulting fabric has a basis weight ranging from 80-170 g/m$^2$.

Japanese Patent Application No. 11-81096 discloses knit fabrics made by Raschel or tricot knitting machines, which comprises PTT fibers and elastic fibers, wherein the content of the elastic fibers is 5 to 30 weight %, elastic draft of 1.5 times-3.5 times, and the fineness ratio of elastic fibers to PIT fibers is 0.1-15, preferably 0.5-9. In one example disclosed therein, a tricot knitting machine of 28 gauge was used to make a soft fabric of unspecified pattern containing 50 d/36 f PTT fibers and 40 d polyurethane fibers, where the run-in of the front bar is 160 cm/480 courses (i.e. 1 rack) and the run-in of the back bar is 80 cm/480 courses.

As discussed above, there is a continuing effort, especially in the performance wear industry, to provide a stretchable fabric with good hand feel, comfortable stretch, and high durability, such as excellent colorfastness after continuous exposure to harsh condition such as to chlorine and UV radiation. The present invention fulfills such efforts.

SUMMARY OF THE INVENTION

A first aspect of the invention includes a warp knit fabric having a locknit pattern comprising:

polytrimethylene terephthalate (PTT) yarn having a total fineness in the range of 30-75 deniers, and elastic yarn having a total fineness in the range of 20-70 deniers and an elongation at break greater than 100%, wherein the warp knit fabric having a locknit pattern comprises:

(a) a weight ratio between the PTT yarn and the elastic yarn in the range of 70:30 to 90:10;

(b) a course density in the range of 15-35 courses/cm and a basis weight in the range of 180 g/m$^2$ or greater; and (c) an elongation in the range of 120% to 185% in the warp direction and an elongation in the range of 80% to 150% in the weft direction.

A second aspect of the invention includes methods of manufacturing the warp knit fabric having a locknit pattern, wherein the elastic yarn has a total draft in the range of 2.6 times to 4.0 times as calculated by equation (1):

$$TD_e = BD_e \times [RI_{ptt}/RI_e] \times LK \times SD \quad (1)$$

where $TD_e$: total draft of the elastic yarns;

$BD_e$: beam draft of the elastic yarns is 1.7 times;

$RI_{ptt}$: run-in length of the PTT yarns ranges from 1400-2000 mm/rack;

$RI_e$: run-in length of the elastic yarns ranges from 200-1000 mm/rack;

LK: locknit pattern run-in ratio is 1.33; and

SD: spool draft of the elastic yarns is 1.0 time.

DETAILS OF THE INVENTION

Figure 1:
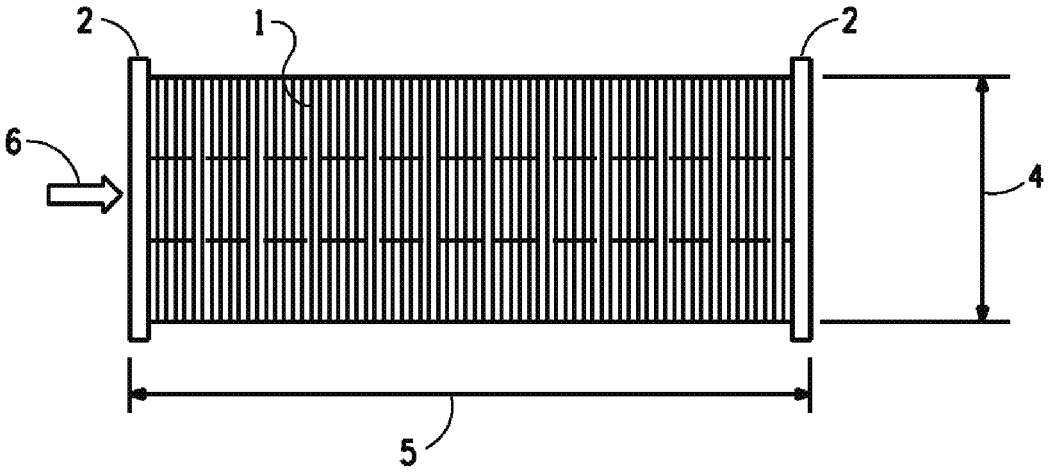
FIG. 1 is a schematic diagram of a beam for either PTT yarns or elastic yarns.

All publications, patent applications, patents and other references mentioned herein, if not otherwise indicated, are explicitly incorporated, by reference herein in their entirety for all purposes as if fully set forth.

Unless otherwise defined, all technical and scientific terms used herein have the same meaning as commonly understood by one of ordinary skill in the art to which this invention belongs. In case of conflict, the present specification, including definitions, will control.

Unless stated otherwise, all percentages, parts, ratios, etc., are by weight.

As used herein, the term "produced from" is synonymous to "comprising". As used herein, the terms "comprises," "comprising," "includes," "including," "has," "having," "contains" or "containing," or any other variation thereof, are intended to cover a non-exclusive inclusion. For example, a composition, process, method article, or apparatus that comprises a list of elements is not necessarily limited to only those elements but may include other elements not expressly listed or inherent to such composition, process, method, article, or apparatus.

The transitional phrase "consisting of" excludes any element, step, or ingredient not specified. If in the claim, such a phrase would close the claim to the inclusion of materials other than those recited except for impurities ordinarily associated therewith. When the phrase "consisting of" appears in a clause of the body of a claim, rather than immediately following the preamble, it limits only the element set forth in that clause; other elements are not excluded from the claim as a whole.

The transitional phrase "consisting essentially of" is used to define a composition, method or apparatus that includes materials, steps, features, components, or elements, in addition to those literally discussed, provided that the additional materials, steps features, components, or elements do not materially affect the basic and novel characteristic(s) of the claimed invention. The term "consisting essentially of" occupies a middle ground between "comprising" and "consisting of".

The term "comprising" is intended to include embodiments encompassed by the terms "consisting essentially of" and "consisting of". Similarly, the term "consisting essentially of" is intended to include embodiments encompassed by the term "consisting of".

When an amount, concentration, or other value or parameter is given as either a range, preferred range or a list of upper preferable values and lower preferable values, this is to be understood as specifically disclosing all ranges formed from any pair of any upper range limit or preferred value and any lower range limit or preferred value, regardless of whether ranges are separately disclosed. For example, when a range of "1 to 5" is recited, the recited range should be construed as including ranges "1 to 4", "1 to 3", "1-2", "1-2 & 4-5", "1-3 & 5", and the like. Where a range of numerical values is recited herein, unless otherwise stated, the range is intended to include the endpoints thereof, and all integers and fractions within the range.

When the term "about" is used in describing a value or an end-point of a range, the disclosure should be understood to include the specific value or end-point referred to.

Further, unless expressly stated to the contrary, "or" refers to an inclusive "or" and not to an exclusive "or". For example, a condition A "or" B is satisfied by any one of the following: A is true (or present) and B is false (or not present), A is false (or not present) and B is true (or present), and both A and B are true (or present).

Also, the indefinite articles "a" and "an" preceding an element or component of the invention are intended to be nonrestrictive regarding the number of instances (i.e. occurrences) of the element or component. Therefore "a" or "an" should be read to include one or at least one, and the singular word form of the element or component also includes the plural unless the number is obviously meant to be singular.

As found herein, the term "homopolymer" refers to a polymer derived from polymerization of one species of monomer; "copolymer" refers to a polymer derived from polymerization of two or more species of monomers. Such copolymers include dipolymers, terpolymers or higher order copolymers.

Embodiments of the present invention as described in the Summary of the Invention include any other embodiments described herein, can be combined in any manner.

The term "denier" or abbreviated as "d" as used herein will be understood to be a relative measure of a fineness (or linear density) of a fiber or yarn. Denier is equivalent numerically to the weight in grams per 9,000 meters length of the material. The term "decitex" is another measure of a fineness of a fiber, which is equivalent to the weight in grams of a 10,000 meter length of the material.

The term "fiber" means a material in which the length to diameter ratio is greater than about 10. Fiber is typically classified according to its fineness. Fiber is generally defined as having a fiber fineness greater than about 15 denier, usually greater than about 30 denier. Fine denier fiber generally refers to a fiber having a fineness less than about 15 denier.

The term "filament fiber" including "monofilament fiber" and "multifilament fiber" means the fiber comprising one or more continuous strands of natural or synthetic material of indefinite (i.e., not predetermined) length, as opposed to a "staple fiber" which is a discontinuous strand of fiber of definite length (i.e., a strand which has been cut or otherwise divided into segments of a predetermined length). The term "yarn" means a continuous strand of twisted threads of natural or synthetic material, such as wool, nylon, or polyester, used in weaving or knitting. The term "fiber" and "yarn" are used interchangeably herein.

The terms "elastic yarn" as used herein will be understood to refer to a yarn made of a synthetic material (i.e. polymer or copolymers) that has the excellent stretchability and recovery such that the material is capable of repeated stretching to at least twice its original length (i.e. 100% elongation), as well as immediate and forcible recovery to its approximate original length upon release of stress.

The term "draft" as used herein refers to the amount of stretch applied to a strand of elastic yarn, such as spandex, resulting in a reduction in fineness of the strand of elastic yarn. The draft of a fiber is directly related to the elongation (stretching) applied to the fiber. For example, 100% elongation corresponds to 2 times draft, and 200% elongation corresponds to 3 times draft, etc.

"Non-elastic yarn" or "hard yarn" as used herein interchangeably means a fiber that is relatively not elastic as the "elastic yarn" defined above. In accordance with the present invention, the "hard yarn" is a continuous multi-filament yarn, such as PTT, nylon, PET, rayon, acetate, or acrylic; although PTT is considerably more elastic in character than other listed hard yarns.

As used herein, the term "warp direction" refers to the length direction or the machine direction of the fabric, and the term "weft direction" refers to the width direction or the cross machine direction of the fabric.

The term "total draft of elastic yarn" as used herein will be understood to be a composite of key factors correlating to the performance of the warp knit fabric of locknit pattern. The calculation of total draft of elastic yarn is described in further detail herein below.

PTT Yarn

The polytrimethylene terephthalate (PTT) yarns may be used in the warp knit fabrics having multiple filaments having a single intrinsic viscosity (IV), which differs from a composite fiber containing two kinds of PTT (i.e. having different IVs) as disclosed in U.S. Pat. No. 6,949,201.

Polytrimethylene terephthalate (PTT) resin is a polyester that may be prepared by the condensation polymerization of 1,3-propanediol and terephthalic acid. Alternatively, polytrimethylene terephthalate may also be prepared from 1,3-propanediol and dimethylterephthalate (DMT). The 1,3-propanediol for use in making the PTT is preferably obtained biochemically from a renewable source ("biologically-derived" 1,3-propanediol).

Because processes for making PTT resin are well known to one skilled in the art, further description is omitted herein.

The PTT resin is preferably a homopolymer or a copolymer containing 90 mol % or more of repeating units of trimethylene terephthalate and 10 mol % or less of other ester units made from other diols and/or diacids.

When the copolymer is employed, other diacids that are useful in copolymerization including aromatic dicarboxylic acids such as isophthalic acid, 5-sodium sultanate isophthalate, phthalic acid, and 2,6-naphthalene dicarboxylic acid; aliphatic dicarboxylic acids such as adipic acid, azelaic acid, sebacic acid, and 1,12-dodecanedioic acid.

Examples of other diols include aliphatic diols such as ethylene glycol, 1,2-propanediol, 1,4-butanediol, neopentyl glycol, 1,6-hexanediol, and polyethylene glycol; and alicyclic diols such as 1,4-cyclohexane dimethanol. These diols and/or diacids may be used either singly or in the form of a mixture of two or more compounds. The most preferred PTT resin is a homopolymer.

Intrinsic viscosity (IV) is a measure of the molecular weight of a polymer and may be measured according to ASTM D4603-96. Intrinsic viscosity typically increases with increasing polymer molecular weight, but is also dependent on the type of macromolecule, its shape or conformation, and the solvent it is measured in.

In one embodiment, in the warp knit fabric of the present invention, the polytrimethylene terephthalate yarn is derived from PTT resin having an intrinsic viscosity (η) of about 0.8 to 1.2 dl/g, and preferably of about 0.9-1.1 dl/g.

Commercially available polytrimethylene terephthalates resin include without limitation SORONA® from DuPont and CORTERRA® from Shell Chemicals. The commercially available PTT resin in pellet form can be readily remelted and spun into filament yarn, or used directly in a spinning process by using a conventional apparatus known to one skilled in the art.

Additives may be contained in the PTT resin pellets or added during the fiber spinning process. Such additives may include delusterants, for example, titanium oxide, heat stabilizers, antioxidants, antistatic agents, UV light absorbers, anti-fungal agents, or various pigments.

The cross-sectional shape of a single PTT filament is not limited, and may be round, or in other shapes such as octalobal, delta, sunburst (also known as sol), scalloped oval, trilobal, tetra-channel (also known as quatra-channel), scalloped ribbon, ribbon, or starburst. The PTT filament may be solid, hollow or multi-hollow, but is preferably solid.

A wide variety of filaments of different fineness may be used to form a PTT yarn. Preferably, a single PIT filament has a fineness of at least about 0.5 dpf (denier per filament), and up to about 5 or more dpf.

Suitable PTT yarns are multifilament yarns that typically comprise at least 10 or more filaments, and preferably contain up to 80, more preferably up to 100 filaments. Yarns containing 10, 12, 24, 36, 18, 68 or 72 filaments are common. The PTT yarns typically have a total fineness of at least 30 d, preferably at least 40 d, and up to 60 d, preferably up to 75 d or more.

In one embodiment, in the warp knit fabric, the PTT yarn is a multi-filament yarn containing about 10-72 filaments and has a total fineness of about 30-75 deniers.

The PTT yarns used to make the warp knit fabrics are yarns such as fully drawn yarn (FDY), partially oriented yarn (POY), spin annealed yarn (SAY), draw textured yarn (DTY) or air texture yarn (ATY).

The content of polytrimethylene terephthalate yarns employed in the warp knit fabric ranges from about 70 weight % to about 90 weight %, preferably from about 75 weight % to about 85 weight %, wherein the weight percentage is based on the total weight of the warp knit fabric.

Elastic Yarn

The elastic yarn used in the warp knit fabric is produced from synthetic material and has an elongation at break of 100% or greater, preferably, 200% or greater, and more preferably, 300% or greater.

Examples of elastic yarn that may be used include without limitation spandex, elastane, anidex, elastoester, and combinations thereof. Preferably, the elastic yarn is a spandex yarn.

Spandex yarns, comprising of at least 85% of a segmented polyurethane, can be formed from the polyurethane polymer solution through fiber spinning processes such as wet or dry spinning. In dry spinning, the polymer solution is metered through spinneret orifices into a spin chamber to form a filament or can be coalesced by conventional techniques into multi-filament yarns. Typically, the polyurethane polymer is dry spun into filament from the same solvent that is used for the polymerization reactions. Gas is passed through the chamber to evaporate the solvent to solidify the filament.

Commercially available spandex yarns include, for example. Lycra® types T162B, T162C, T165C, T169B and T562, manufactured by INVISTA; ROCIA® by Ashahi; CREORA® by Hyosung; and AOSHEN® by Jiangsu Aoshen Group, Co. Ltd.

The elastic yarns can also comprise conventional additives such as anti-tack agents, antioxidants, UV screeners, antimicrobials, brighteners, delustrants, flame retardants, lubricants, and dyestuffs. For example, a lubricant can be deposited on the surface of the elastic filaments by a conventional finish roll or by being co-spun with the filament from the polymer solution, or by both methods. In the case of a spandex yarn, the dry-spun spandex yarn is then wound up to form a yarn supply package.

The elastic yarns can be a monofilament yarn or a multifilament yarn and have a fineness of at least about 20 d, at least about 30 d, at least about 45 d, or at least about 70 d.

In one embodiment, in the warp knit fabric, the elastic yarn is a spandex yarn having an elongation at break of 100% or greater and a fineness of about 20-70 deniers.

The content of elastic yarns employed in the warp knit fabric ranges from about 10 weight % to about 30 weight %, or from about 15 weight % to about 25 weight %, wherein the weight percentage is based on the total weight of the warp knit fabric.

Manufacturing a Warp Knit Fabric

For warp knit fabrics, the appropriate gauge of a tricot knitting machine is selected according to the uses of the warp knit fabrics, particularly when used in garments that include swimwear, sportswear and intimate apparel. The gauge number of the tricot knitting machine is one of the many factors affecting the stretchability and basis weight of the resulting fabric. In the present invention, a 32 gauge is preferred over a 28 gauge tricot knitting machine.

Figure 2:
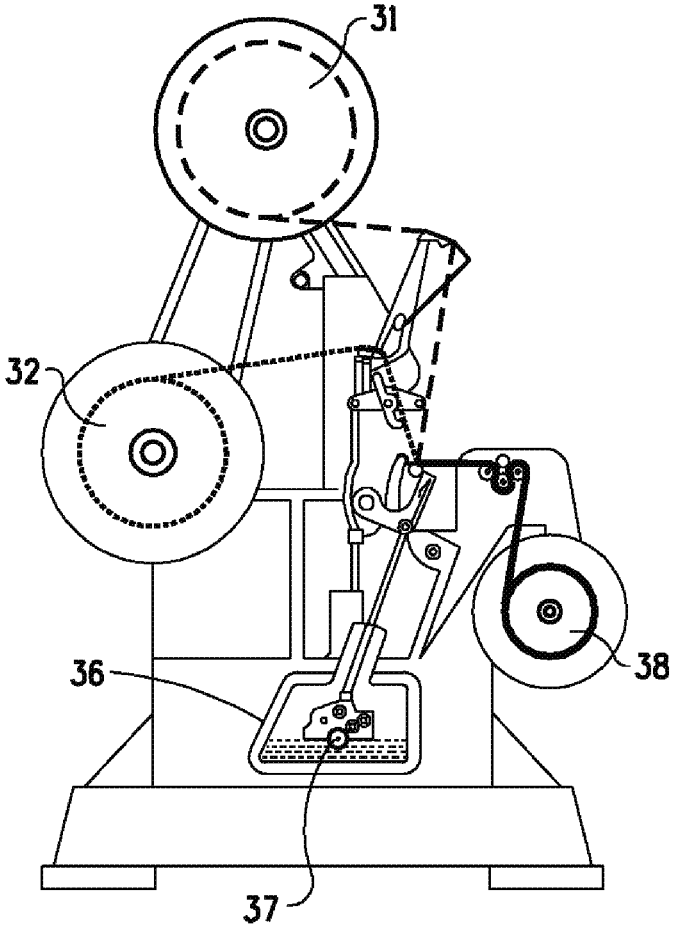
FIG. 2 is a schematic diagram of a portion of a tricot knitting machine with 2 guide bars for elastic yarns and PTT yarns.

To prepare the warp knit fabrics, a schematic illustration of the tricot knitting machine with 2 fully threaded guide bars is shown in FIG. 2, and optimized parameters are described below in detail. In an embodiment, the method uses a 32 gauge, 130 in. (330 cm) wide tricot machine.

FIG. 2 illustrates a typical tricot machine. They rarely have more than four guide bars, most use two guide bars. The hard yarn, e.g., PTT yarn is mounted on the front warp 31 and elastic yarn, e.g., spandex yarn is mounted on the back warp 32. The warp tension is controlled by a warp tension rail 33. The loop formation activity is controlled by knitting elements 34 which are motored by a main eccentric shaft knitting element drive 37. When a fabric is being knitted, it is taken up by a fabric take-up roller 35 and rolled on the take-up beam 38. The whole tricot knitting machine is supported by a machine bed 36.

Figure 3A:
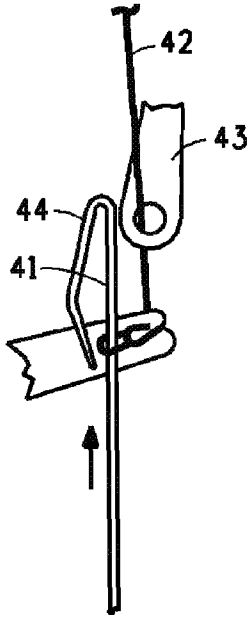
FIGS. 3A-3E are schematic diagrams of needle motion in a knitting process.
Figure 3B:
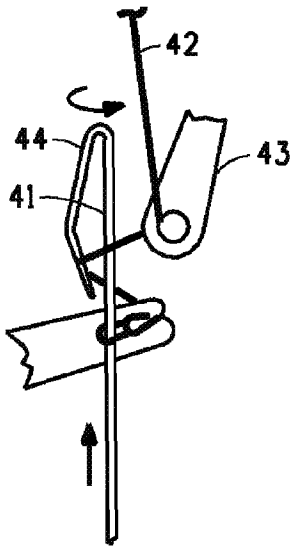
Figure 3C:
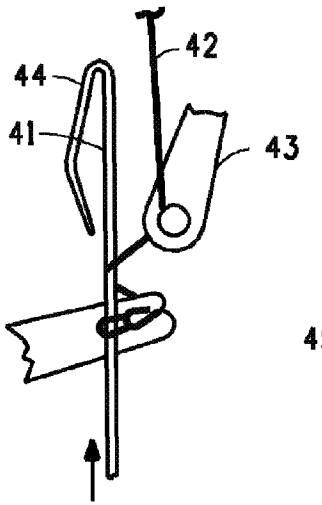
Figure 3D:
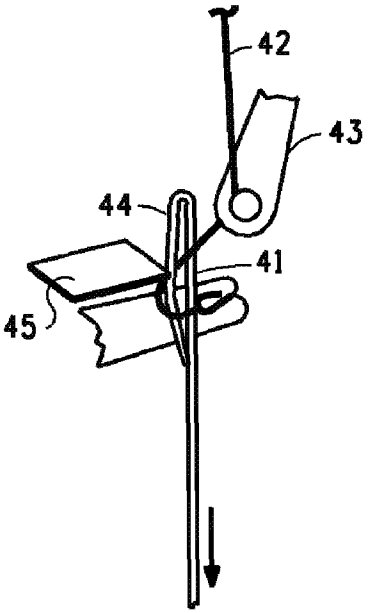
Figure 3E:
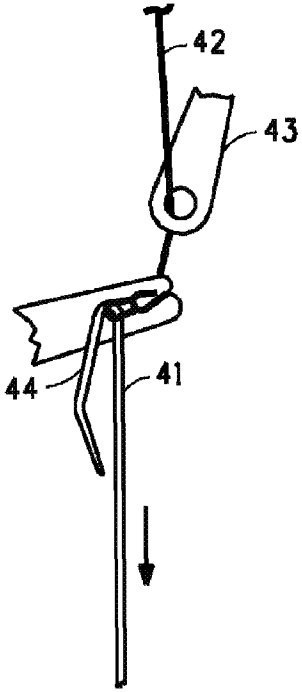

FIGS. 3A-3E illustrates the knitting action of spring beard needles. At the start of a stitch cycle, FIG. 3A shows the needle moves upward (as indicated by the arrow) and the previously formed loop slides down to the needle stem 41. Then in FIG. 3B, a yarn 42 wraps around the needle through the action of the yarn guide 43. As the needle continues to rise up (in FIG. 3C), the yarn 42 slides onto the needle stem 41. Then the needle begins its descent in FIG. 3D. The yarn slides inside the beard 44, the presser bar 45 moves forward to close the beard 44, and the old loop slides off the closed beard as the needle moves downward, and the presser bar 45 retracts. In FIG. 3E, the needle continues downward, the yarn inside the beard 44 passes through the old loop and the old loop slides off the needle to complete a loop.

Figure 4B:
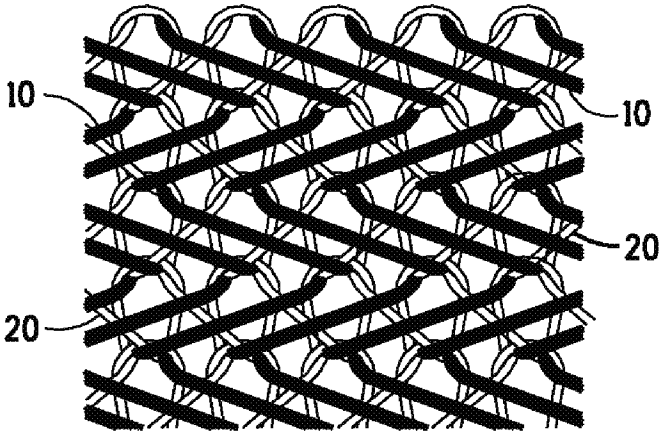
FIGS. 4A-4B show the reverse side views of common warp knit fabrics patterns. The warp knit fabrics are constructed with the locknit pattern shown in FIG. 4B.
Figure 4A:
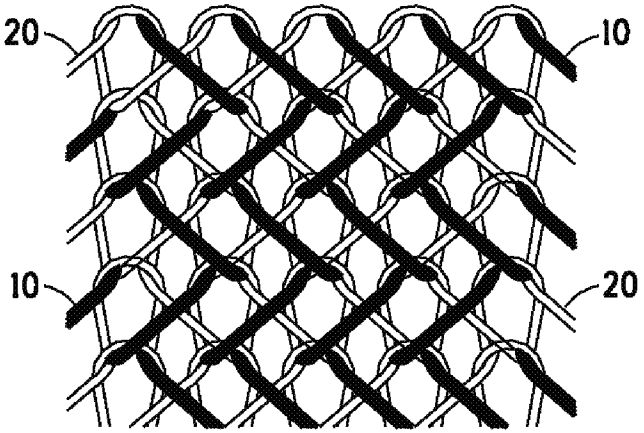

FIG. 4A shows the simplest form of two-bar warp knit fabrics, known as single tricot pattern, which is a basic one-face warp knitting, in which the guide bars move in opposition and make closed laps, moving one needle space right and left alternatively after each course. The hard yarns 10 in black are supplied by the front guide bar and the elastic yarns 20 (in white) are supplied by the back bar.

FIG. 4B shows the locknit pattern, in which the guide bars move in opposition at all times, but the overlap of the underlaps is always over one needle space, the underlaps thus are different from that of a single tricot pattern. The front guide bar makes a two needle space move while the back guide bar moves only one needle space and in opposite direction. The face (or front side) of the fabric shows almost vertical wales with a fine smooth texture, whereas the back (or reverse side) of the fabric is comparatively coarse because of the longer underlaps made by the front bar. The structure of the fabric is that the threads carried by the front guide bar (i.e. PTT yarns) are more prominent on the reverse side, where the diagonal floats, shown in black lines in FIG. 4B. It is known that in all two-bar warp knit fabrics, there is a tendency for the yarns of the front guide bar appearing most prominently on the face of the fabric. Therefore, the PTT yarns, which are supplied from the front guide bar, become the main contributor for good hand feel of the warp knit fabrics.

Figure 5:
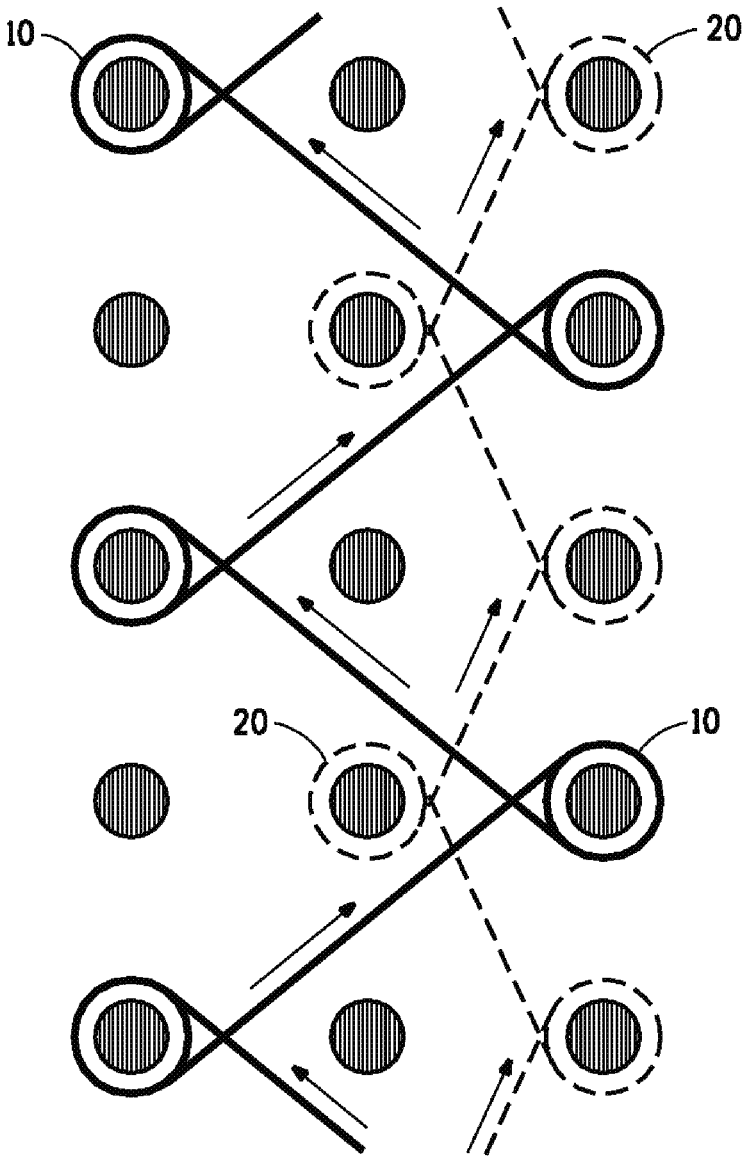
FIG. 5 is a schematic diagram of the paths of a PTT yarn and its neighboring elastic yarn on a dot paper forming the locknit pattern of the warp knit fabric.

The guide bar lapping movements for the warp knit fabric of locknit pattern are portrayed on dot paper in FIG. 5 and the relative paths for a PTT yarn 10 and its neighboring elastic yarn 20 are as follows:

Front guide bar (PTT yarn): 2-3/1-0//; Back guide bar (elastic yarn): 1-0/1-2//, and repeat.

The main factor controlling the fabric quality is the rate of "run-in length" of each warp, i.e. the total length of yarn supplied from each warp during one rack, i.e. 480 courses. Because the locknit pattern requires the yarns of the front bar to supply the greater length in the underlap, it is known that in producing the locknit fabric the ratio of the front bar to the back bar run-in length is approximately 4:3 (or 1.33). However, the optimal run-in ratio between PTT yarn and elastic yarn is still a matter for determination by trial and error rather than precise calculation. In an embodiment, it is found to produce commercially useful warp knit fabrics having a ratio of run-in length of PTT yarn ($RI_{ppt}$):run-in length of elastic yarn ($RI_e$) greater than 2.0; preferably the ratio of $RI_{ppt}$:$RI_e$ is from 2.2 to 2.8.

In one embodiment, the method for producing commercially useful warp knit fabrics of locknit pattern comprises elastic yarns and PTT yarns by maintaining the elastic yarn to have a total draft in the range of 2.6 times to 4.0 times, which is calculated by equation (1) as follows:

$$TD_e = BD_e \times [RI_{ppt}/RI_e] \times LK \times SD \quad (1)$$

where $TD_e$: total draft of the elastic yarns;

$BD_e$: beam draft of the elastic yarns, which is 1.7 times;

$RI_{ppt}$: run-in length of the PTT yarns, which ranges from about 1400-2000 mm/rack;

$RI_e$: run-in length of the elastic yarns, which ranges from about 200-1000 mm/rack;

LK: locknit pattern run-in ratio, which is 1.33; and

SD: spool draft of the elastic yarns, which is 1.0 time.

The present invention has identified that improved results are obtained over the prior art when the total draft of elastic yarn is in the range of from 2.6 times to 4.0 times, preferably from 2.8 times to 3.6 times, and more preferably from 3.0 times to 3.4 times.

Because of its stress-strain properties, elastic yarn drafts (draws) more as the tension applied to the elastic yarn increases; conversely, the more that the elastic yarn is drafted, the higher the tension in the yarn. In one embodiment of the method of this invention, the tension of elastic yarn is kept at about 1-2 g. The tension is sufficiently high for reliable and continuous feeding of the elastic yarn to the knitting needles, and sufficiently low to keep the beam draft of the elastic yarn to be at about 1.7 times.

In an embodiment the ratio of $RI_{ptt}$:$RI_e$ is 2.0 or greater.

In an embodiment the ratio of $RI_{ptt}$:$RI_e$ is in the range of 2.2 to 2.8.

Another aspect of the invention includes the use of the warp knit fabrics of locknit pattern for garments, which may include swimwear, sportswear and intimate apparel.

Finishing Process of the Greige Fabric

After knitting, the warp knit fabric is called greige fabric. The greige fabric is finished in the process illustrated diagrammatically in FIG. 6 designated as 50.

The greige fabric obtained from the knitting process is processed through wet processes of scouring (cleaning), is also called relaxation 51. The relaxed fabric is then applied to a tenter frame and heat set in a heat set machine. The tenter frame holds the fabric on the edges by needle chains, and stretches it in both the length and width directions in order to return the fabric to desired dimensions and basis weight.

This heat setting 52 is accomplished before subsequent wet processing steps and, consequently, heat setting is often referred to as "pre-setting" in the trade. At the exit of the heat set machine, the flat fabric is released from the needle chains. The fabric then is processed optionally, through path A: bleaching 53, or path B: dyeing 54, by over-flow jet equipment. With path A, the fabric can be subjected to the printing process to make printed fabric. After bleaching 53 or dyeing 54, the fabric is dried and heat set 55 in a tenter-frame oven under conditions of fabric overfeed (opposite of stretching) so that the fabric is under no tension in the length (machine) direction while being dried at temperatures below pre-setting temperatures. The fabric is slightly tensioned in the width direction in order to flatten any potential wrinkling.

Stretching and heat setting parameters are chosen to yield the desired fabric basis weight and elongation, within relatively tight limits. For a typical stretchable fabric suitable for a garment such as swimwear, sportswear or intimate apparel, the desired elongation in the warp direction is at least 100%, and the basis weight is about 100 g/m$^2$ or more for intimate apparel, and about 150 g/m$^2$ or more for swimwear or sportswear. Heat setting of dry fabric in a tenter frame or other drying apparatus is also known as re-deniering, wherein an elastic yarn of higher denier is drafted, or stretched, to a lower denier, and then heated to a sufficiently high temperature for a sufficient time to stabilize the elastic yarn of the fabric at the lower denier. Heat setting therefore means that the elastic yarn of the fabric permanently changes at a molecular level so that recovery tension in the stretched elastic yarn is mostly relieved and the elastic yarn becomes stable at a new and lower denier. The heat setting operation therefore improves the stability of the fabric, and reduces the amount that the fabric will shrink after repeated washings.

Heat setting temperatures for elastic yarn (i.e. spandex) are generally in the range of about 175° C. to about 200° C. For the process 50 shown in FIG. 6, the heat setting 52 for the warp knit fabric is typically done at about 180° C. to about 190° C. for about 30 seconds or more.

Care should be taken to minimize any additional tension applied during fabric processing and transport from wet finishing (including scouring, bleaching 53 or dyeing 54) to the heat set machine, and also enable the warp knit fabric to relax and recover from such wet-finishing and transport tensions during final heat set step 55.

Following wet finishing process steps, the warp knit fabric is delivered to a finish/dry step for an optional finish application softener by padding) and subsequent heat set in a heat set machine under conditions of fabric length overfeed. For example, softeners such as SURE SOFT® or SANDOPERM SEI® are typical.

The final heat set step is operated with controlled, high fabric overfeed in the length (machine) direction so that the fabric stitches are free to move and rearrange without tension. A flat, non-wrinkled or non-buckled fabric emerges after final heat set. These techniques are familiar to those skilled in the art. The fabric final heat set temperature and residence time are set below the values required to pre-heat set the spandex yarn. In one embodiment, in the method of the invention, the final heat set temperature is at the range of 160-170° C. for about 30 seconds or more.

The above procedure and additives will be familiar to those experienced in the art of textile manufacturing and warp knitting fabrics.

Warp Knit Fabric Characterization

The warp knit fabric of locknit pattern, manufactured by the method of the present invention, generally has a basis weight of about 180 g/m$^2$ or greater. Preferably, the basis weight of the warp knit fabrics used herein will range from about 180 g/m$^2$ to about 250 g/m$^2$, or from about 190 g/m$^2$ to about 230 g/m$^2$.

In one embodiment, the warp knit fabrics of this invention have a basis weight of about 180 g/m$^2$ or greater, or from about 180 g/m$^2$ to about 250 g/m$^2$, or from about 190 g/m$^2$ to about 230 g/m$^2$.

The warp knit fabric has an elongation of from about 120% to about 185%, or from about 130% to about 175% in the warp direction; an elongation of from about 80% to about 150%, or from about 105% to about 135% in the weft direction.

The warp knit fabrics are useful in various durable or repeated-use fabric applications such as, but not limited to, garments including swimwear, sportswear, and intimate apparel.

The warp knit fabrics of the invention also has a shrinkage after washing and drying of about 7% or less, typically, 5% or less, for example less than about 4% in both warp and weft directions.

Another aspect of the present invention is to provide warp knit fabrics of a locknit pattern with softer hand feel, higher durability, and better colorfastness in terms of resistance to degradation by chlorine and UV radiation when compared to known stretchable fabrics made with nylon/spandex or PET/spandex.

Embodiments of the present invention are further defined in the following Examples. The materials, methods, and examples herein are illustrative only and, except as specifically stated, are not intended to be limiting. Although methods and materials similar or equivalent to those described herein can be used in the practice or testing of the present invention, suitable methods and materials are described herein.

EXAMPLES

The abbreviation "E" stands for "Example" and "CE" stands for "Comparative Example." is followed by a number indicating in which example the warp knit fabric is prepared. Percentages are by weight unless otherwise indicated.

Materials

Polytrimethylene terephthalate fiber of 50 d/24 f FDY (fully drawn yarn), was made from DuPont Sorona® polymer (IV 0.96, semi-dull, contains 0.3% of $TiO_2$). The elongation at break is 60%, tenacity is 3.1 cN/dtex, spinning oil is 1.7%, boil water shrinkage is 6.9%.

Spandex monofilament yarn of 40 d, obtained from INVISTA, Wichita, Kans., elongation at break of 550%, tenacity is 1 g/denier, coated with 15% spin oil.

Examples 1-16 and Comparative Examples 1-2

General Method of Manufacturing a Warp Knit Fabric

A beam for PTT yarn or spandex yarn (1) is illustrated in FIG. 1, which has 2 flanges (2), with a beam width (5) of 21 inches (53.3 cm) and a diameter (4) of 21 inches (53.3 cm), the shaft (6) of the knitting machines is inserted through six beams to make a beam set.

There were 688 ends of PTT yarns per beam. The beaming was conducted on a SH1200 beam machine. The beaming tension was set to be about 3-4 g, and beaming speed was 500 m/min.

In a similar fashion, there were 684 ends of spandex yarns per beam for the other beam set of six beams. The beaming was conducted on a Karl Mayer elastic fiber beam machine. The spandex beaming tension was maintained at 1-2 g, beaming speed was 360 m/min.

The greige fabric was knitted on a Karl Mayer 32E tricot knitting machine of 130 inches wide. The PTT yarns were fed from the front guide bar and the spandex yarns were fed from the back guide bar.

The knitted pattern of the warp knit fabric was a locknit pattern as shown in FIG. 4B. Run-in length of the PTT yarns ranged from 1400 mm/rack to 1650 mm/rack, and run-in of the spandex yarn ranged from 500 mm/rack to 650 mm/rack. The knitting machine was running at a speed of 2000 courses/min. The fabric density is in the range of 18 courses/cm to 30 courses/cm.

The knitting parameters for each fabric sample are listed in Table 1. Typically, the greige fabric was produced at a length of about 100-120 meters and a width of 140-150 cm (or 55-59 inches).

General Procedures of Warp Knit Fabric Finishing

Figure 6:
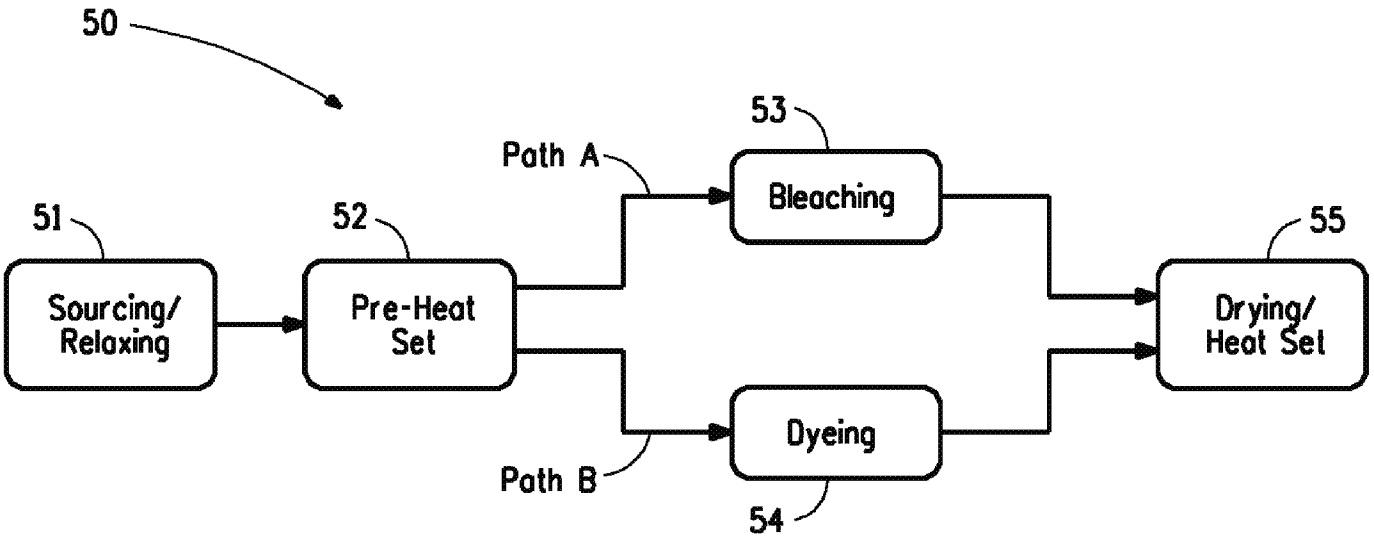
FIG. 6 is a flow chart showing the general finishing process steps after obtaining the greige fabrics of this invention.

The warp knit fabric sample was scoured, pre-heat set, dyed, and dried per the process as shown in FIG. 6.

(a) Scouring/Relaxing

The fabric was scoured in a scouring machine (LMH988 made by Nantong Jingwei textile machinery co., Ltd.) to remove the impurities, oils etc, using 0.5-1 g/L of hydrosulfide, 1-2 g/L of non-ionic detergent, 1-2 g/L of NaOH to adjust pH to 8-10, optional with 1-2 g/L of hydrogen peroxide (when bleaching is required); processed for 30 minutes at 90° C. without width tension, rinsed with water or acetic acid containing water at 60° C. for 10 minutes.

(b) Pre-Heat Set

The fabric was then pre-heat set at 185° C. for 50-60 seconds on a MONFORTS tenter frame with 20-30% expanding on width and 10-15% elongation on length direction.

(c) Bleaching and Dyeing

The fabric after pre-setting was put into a dyeing machine (Fong's ECO 06 made by Fong's) with a programmed dyeing temperature profile. The dye bath started with heating to 50° C. and holding the bath temperature for 10 min, then raising the bath temperature at 2° C./min to 80° C., further raising the bath temperature to 115° C. at 1° C./min, and then holding the bath temperature for 30 min to ensure the dyeing completion. Afterwards, the dye bath was cooled down to 60° C. at a rate of 2.5° C./min, letting the bath further cool down to ambient temperature naturally.

The dye solutions contained 1-2% of a disperse dye, 0.5% "Merpol" LFH (low foam non-ionic surfactant, purchased from Guangzhou Diecheng Trading Co., Ltd). 0.5% "Versene" 100 (sequestering agent, purchased from Guangzhou Diecheng Trading Co., Ltd.), and 0.5% $CH_3COOH$ to maintain the solution at pH5. The dye bath ratio of dye solution to dry fabric weight is 10:1. Two disperse dyes were used to obtain fabric sample of blue and white color, respectively; for blue color: the dye stuff was purchased from Clariant under the tradename of Foron® RD-E; for bleach white color: the bleach was purchased from Clariant under the tradename of Peractive® TAED.

The fabric was rinsed with over flow at room temperature for 10 min. After dyeing, the fabric was cleaned at 80° C. for 30 min with a solution containing 2.0 g/L SP-3030 (soaping agent, purchased from Guangzhou Zhuangjie Chemical Co., Ltd), 2.0 g/L NaOH, and 2.0 g/L sodium hydrosulfite. Then fabric was soaked at 60° C. for 10 min with a solution having 2.0 g/L $CH_3COOH$, followed by rinsing with water at room temperature for 10 min.

(d) Drying & Heat Set

After rinsing, the fabric was then dried (i.e. final heat set) on a MONFORTS tenter frame at 165° C. for 30 seconds to provide the finished fabric at a length of about 50-60 meter.

Comparative tricot warp knit fabric 1 (CE1) was made from 40 deniers spandex yarns and 40 deniers nylon 6 yarns, containing 20 weight % spandex yarns and 80 weight % of nylon yarns, having a basis weight of 200 g/m$^2$ and manufactured by Charming (Guangdong, China).

To obtain the bleach white CE1 and blue CE1 it was bleached and dyed using an acid dye (purchased from Huntsman under the tradename of DRIONYL®) under condition optimized for the CE1 fabric.

Comparative tricot warp knit fabric 2 (CE2) was made from 40 deniers spandex yarns and 40 deniers polyethylene terephthalate (PET) yarns, containing 20 weight % spandex yarns and 80 weight % PET yarns, having a basis weight of 200 g/m$^2$, and manufactured by Huiyi (Guangdong, China).

To obtain the bleach white CE2, it was bleached under the condition mentioned in step (c) above and was the same as Example 10.

Test Methods (A) Hand feel: The fabric samples of 60 cm×60 cm per piece were evaluated by 5 individuals who are skilled in the art to assess the hand feel of each fabric sample by touching, flexing between fingers and thumb, smoothing and so on, and rated the overall sensory test with 3 categories:

1: good

2: better

3: best

The results were averaged and rounded to an integer, then reported.

(B) Fabric Elongation:

The elongation was measured in both the warp and weft directions. Three fabric samples were used to ensure consistency of results. Fabric sample was slit into a size of 50 mm×150 mm, in a way that the length of the sample is aligned with the weft or warp direction of the fabric.

This analysis was performed on an Instron Model 5565 equipped with the Merlin data collection software system according to the method BS 4952. Both the Merlin system and instrument hardware were purchased from Instron Corporation (Braintree, Mass.).

The fabric was clamped in the jaws of the Instron machine with a sample length set at 100 mm under up to a force of 3.6 Kg and at an elongation speed of 500 mm/minute. Cycled twice between zero extension and the specified force. From the force versus extension graph produced on the 2$^{nd}$ cycle, an elongation at the load of 3.6 Kg was reported.

(C) Modulus at 60% stretch: The modulus was reported in grams, the value was taken at 60% elongation from the force versus extension graph produced on the 2$^{nd}$ cycle in the Fabric Elongation test (B).

(D) Fabric Weight: Knit fabric samples were die-punched with a 10 cm diameter die. Each cut-out knit fabric sample was weighed in grams. The "fabric weight" was then calculated as g/m$^2$.

(E) Chlorine resistance test: The fabric samples were immersed for 1 hour at room temperature in a running bath containing 5 ppm active chlorine which represented a chlorine concentration that was the environment in a swimming pool. After exposure, the samples were rinsed with deionized water and allowed to air dry overnight before making visual assessment.

For fabric samples of blue color, the chlorine treatment caused some color fading; for fabric samples of white color, the chlorine treatment caused yellowness. The color change (colorfastness) of the fabric samples were visually graded according to the Gray Scale for Color Change in accordance to the method of AATCC 162.

(F) UV resistance test: The fabric samples were placed with the comparison standards, and exposed to UV radiation according to condition specified for option 3 in the method of AATCC 16E. The fabric samples were visually graded for color changes after 10 hours or 20 hours exposure to UV radiation using the Gray Scale for Color Change according to the method of AATCC 16E.

(G) Shrinkage: The fabric samples were cut into 38 cm×38 cm square, and the edges of the test sample was parallel to either the warp or the weft directions. The fabric samples were prepared according to the option 1 of the sampling and preparation section 6 in the method AATCC 135. The fabric samples were machine washed at 41° C. using normal cycle, and tumble dried using the condition for delicate fabric according to the method AATCC 135. The fabric samples were washed and dried for 3 times, and then the shrinkage was recorded and percentage was calculated.

Table 1 below sets forth the knitting parameters for the fabric examples and the hand feel results.

TABLE 1

| Example number | PTT run-in, mm/rack | Spandex run-in, mm/rack | Course density, course/cm | Spandex total draft, times | Hand feel rating |
|---|---|---|---|---|---|
| E1 | 1550 | 750 | 25 | 2.6 | 2 |
| E2 | 1450 | 700 | 30 | 2.6 | 1 |
| E3 | 1500 | 700 | 30 | 2.7 | 2 |
| E4 | 1400 | 650 | 25 | 2.8 | 1 |
| E5 | 1650 | 750 | 18 | 2.8 | 2 |
| E6 | 1450 | 620 | 30 | 3.0 | 2 |
| E7 | 1540 | 650 | 20 | 3.0 | 3 |

TABLE 1-continued

| Example number | PTT run-in, mm/rack | Spandex run-in, mm/rack | Course density, course/cm | Spandex total draft, times | Hand feel rating |
|---|---|---|---|---|---|
| E8 | 1550 | 650 | 25 | 3.0 | 3 |
| E9 | 1550 | 650 | 25 | 3.0 | 3 |
| E10 | 1580 | 620 | 20 | 3.3 | 3 |
| E11 | 1580 | 600 | 25 | 3.4 | 3 |
| E12 | 1400 | 530 | 30 | 3.4 | 1 |
| E13 | 1400 | 500 | 30 | 3.6 | 1 |
| E14 | 1500 | 530 | 30 | 3.6 | 2 |
| E15 | 1450 | 510 | 25 | 3.6 | 1 |
| E16 | 1645 | 530 | 18 | 4.0 | 2 |

As listed in Table 1, the warp knit fabrics of Example 1-16 have a total draft of elastic yarn ranging from 2.6 times to 4.0 times, and a course density of 18-30 courses/cm. The hand feel of each example was rated into 3 categories: good, better, or best. As judging from the hand feel, the results in Table 1 suggests that when the total draft of elastic yarn is at the range of from 3.0 times to 14 times and the fabric density is between 20-25 courses/cm, the warp knit fabric of locknit pattern can deliver the best hand feel.

In one embodiment, the warp knit fabric of locknit pattern of this invention has a total draft of elastic yarn of from 3.0 times to 3.4 times, and a course density of 20-25 courses/cm.

Table 2 below summarizes other key performance results of the warp knit fabrics of locknit pattern of the invention.

TABLE 3

| | Example No. | | | | |
|---|---|---|---|---|---|
| | E10 PTT:spandex (80:20) | | CE1 Nylon:spandex (80:20) | | CE2 PET:spandex (80:20) |
| Color | Blue | White | Blue | White | White |
| Hand feel | 3 | 3 | 2 | 2 | 1 |
| Chlorine colorfastness | 4.5 | 4.0 | 3.5 | 4.0 | 3.5 |
| UV radiation after 10 hr, colorfastness | 4.5 | 4.5 | 3.5 | 4.0 | 4.0 |
| UV radiation after 20 hr, colorfastness | 4.5 | 4.0 | 3.0 | 3.5 | 3.5 |

Table 3 summarizes data on hand feel, colorfastness of chlorine exposure and UV radiation for Example 10 and comparative elastic fabrics CE1 and CE2.

An unexpected advantage is that the warp knit fabrics produced by the method described herein have a better hand feel compared to fabrics of CE1 and CE2 such as nylon/spandex or PET/spandex having the same locknit pattern, same basis weight, and same weight % of spandex yarns.

Also, unexpectedly, the warp knit fabrics have significantly better colorfastness after chlorine exposure and UV radiation for 10 hours and 20 hours.

TABLE 2

| Example number | Warp elongation, % | Weft elongation, % | Warp Modulus, g | Weft Modulus, g | Hand feel rating | Warp shrinkage, % | Weft shrinkage, % |
|---|---|---|---|---|---|---|---|
| E1 | 140 | 112 | 289 | 297 | 2 | −2.3 | 0.1 |
| E2 | 137 | 101 | 321 | 415 | 1 | −2.1 | −0.8 |
| E3 | 146 | 109 | 282 | 305 | 2 | −3.5 | 0.7 |
| E4 | 161 | 95 | 227 | 513 | 1 | −2.1 | −1.0 |
| E5 | 157 | 138 | 240 | 184 | 2 | −1.0 | −0.7 |
| E6 | 132 | 97 | 335 | 460 | 2 | −3.0 | −0.8 |
| E7 | 163 | 115 | 228 | 278 | 3 | −1.0 | −1.1 |
| E8 | 149 | 122 | 265 | 254 | 3 | −3.8 | −0.1 |
| E9 | 147 | 119 | 261 | 259 | 3 | −3.8 | −0.1 |
| E10 | 133 | 127 | 278 | 211 | 3 | −3.0 | 0.5 |
| E11 | 167 | 125 | 210 | 222 | 3 | −2.3 | −0.1 |
| E12 | 154 | 92 | 258 | 552 | 1 | −3.1 | −1.7 |
| E13 | 129 | 87 | 335 | 687 | 1 | −2.9 | −1.7 |
| E14 | 160 | 110 | 228 | 316 | 2 | −4.0 | −1.3 |
| E15 | 138 | 91 | 311 | 605 | 1 | −1.7 | −2.0 |
| E16 | 179 | 141 | 186 | 165 | 2 | −2.3 | −0.7 |

As listed in Table 2, the warp knit fabrics of Examples 1-16 have a shrinkage in the both warp and well directions of less than 4%, which is better than the typical industrial requirement, i.e. 5%. Also, the warp knit fabrics of Examples 1-16 have an elongation in the warp direction ranging from 129% to 179%, and an elongation in the weft direction ranging from 87% to about 141%. In order to have a fabric to have comfortable stretch and compression, the elongation in the warp direction is preferably at least 130% or greater and the elongation in the weft direction is preferably at least 105% or greater.

It's interesting to find that the modulus at 60% elongation in the weft direction roughly correlates to the hand feel of the fabric samples. For example, E2, E4, E6, E12, E13 and E15 have a modulus at 60% elongation in the weft direction greater than 400 g; all were rated to have good hand feel (Grade 1) except for E6. While E7, E8, E9, E10 and E11 have a modulus at 60% elongation in the weft direction between 200-290 g; all were rated to have best hand feel (Grade 3).

Although the invention has been described in conjunction with specific embodiments thereof, it is evident that many alternatives, modifications, and variations will be apparent to those skilled in the art. Accordingly, it is intended to embrace all such alternatives, modifications, and variations that fall within the spirit and broad scope of the appended claims.

What is claimed is:

1. A warp knit fabric having a locknit pattern comprising:

polytrimethylene terephthalate (PTT) yarn having a total fineness in the range of 30-75 deniers; and elastic yarn having a total fineness in the range of 20-70 deniers and an elongation at break greater than 100%;

wherein the warp knit fabric having a locknit pattern comprises:

(a) a weight ratio between the PTT yarn and the elastic yarn in the range of 70:30 to 90:10;

(b) a course density in the range of 15-35 courses/cm and a basis weight in the range of 180 g/m2 or greater;

(c) an elongation in the range of 120% to 185% in the warp direction and an elongation in the range of 80% to 150% in the weft direction; and (d) wherein the elastic yarn has a total draft ranging from 2.6 to 4.0 times as calculated by equation (1):

$$TD_e = BD_e \times [RI_{ptt}/RI_e] \times LK \times SD \quad (1)$$

where $TD_e$: total draft of the elastic yarns;

$BD_e$: beam draft of the elastic yarns is 1.7 times;

$RI_{ptt}$: run-in length of the PTT yarns ranges from about 1400-2000 mm/rack;

$RI_e$: run-in length of the elastic yarns ranges from about 200-1000 mm/rack;

LK: locknit pattern run-in ratio is 1.33; and

SD: spool draft of the elastic yarns is 1.0 time.

2. The warp knit fabric of locknit pattern according to claim 1, which has a course density of 20-30 courses/cm and a basis weight of about 180-250 g/m2.

3. The warp knit fabric of locknit pattern according to claim 1 wherein the total draft of the elastic yarns is in the range of 2.8 times to 3.6 times.

4. The warp knit fabric of locknit pattern according to claim 1 wherein the total draft of the elastic yarns is in the range of 3.0 times to 3.4 times.

5. The warp knit fabric of locknit pattern according to claim 1 wherein the ratio of $RI_{ptt}$:$RI_e$ is greater than 2.0.

6. The warp knit fabric of locknit pattern according to claim 1, wherein the ratio of $RI_{ptt}$:$RI_e$ is in the range of 2.2 to 2.8.

7. A garment comprising the warp knitting fabric of locknit pattern according to claim 1.

* * * * *